US011719501B2

(12) United States Patent
Ames et al.

(10) Patent No.: US 11,719,501 B2
(45) Date of Patent: Aug. 8, 2023

(54) APPARATUS FOR IMPROVING THE PERFORMANCE OF FIREARMS

(71) Applicants: Zackery D Ames, Texarkana, TX (US); Ashley A Reel, Texarkana, TX (US)

(72) Inventors: Zackery D Ames, Texarkana, TX (US); Ashley A Reel, Texarkana, TX (US)

(73) Assignee: Zackery D. Ames, Texarkana, TX (US)

( * ) Notice: Subject to any disclaimer, the term of this patent is extended or adjusted under 35 U.S.C. 154(b) by 0 days.

(21) Appl. No.: 17/370,534

(22) Filed: Jul. 8, 2021

(65) Prior Publication Data

US 2022/0082344 A1 Mar. 17, 2022

Related U.S. Application Data

(60) Provisional application No. 63/021,886, filed on May 8, 2020.

(51) Int. Cl.

| | |
|---|---|
| ***F41C 23/12*** | (2006.01) |
| ***F41A 21/32*** | (2006.01) |
| ***F41A 21/48*** | (2006.01) |
| ***F41A 21/36*** | (2006.01) |
| ***F41A 3/66*** | (2006.01) |

(52) U.S. Cl.

CPC ..... *F41A 21/325* (2013.01); *F41A 3/66* (2013.01); *F41A 21/36* (2013.01); *F41A 21/484* (2013.01); *F41C 23/12* (2013.01)

(58) Field of Classification Search

CPC ..... F41C 23/12; F41C 23/10; F41C 23/06; F41C 23/16; F41C 23/04

USPC ..... 42/1.06, 71.02, 72, 73

See application file for complete search history.

(56) References Cited

U.S. PATENT DOCUMENTS

| | | | | |
|---|---|---|---|---|
| 5,180,874 | A | 1/1993 | Troncoso, Jr. | |
| 7,437,847 | B1 | 10/2008 | Mabry | |
| 8,438,771 | B1 | 5/2013 | Boone | |
| 8,448,366 | B2 * | 5/2013 | Faifer | F41G 11/003 42/72 |
| 10,330,432 | B2 * | 6/2019 | Silverman | F41C 23/04 |
| 11,156,433 | B2 * | 10/2021 | Griffith | F24F 11/72 |
| 2011/0088305 | A1 * | 4/2011 | Oz | F41C 23/12 42/69.01 |
| 2012/0131829 | A1 * | 5/2012 | Fistikchi | F41C 23/22 42/1.06 |
| 2015/0316346 | A1 * | 11/2015 | Brandt | F41C 23/12 42/71.02 |

(Continued)

FOREIGN PATENT DOCUMENTS

| | | | | |
|---|---|---|---|---|
| WO | WO-2013132291 | A1 * | 9/2013 | F41A 23/02 |

*Primary Examiner* — Reginald S Tillman, Jr.

(57) ABSTRACT

An apparatus for stabilizing firearms is disclosed. The apparatus comprises a body having a left side module and a right side module secured together by a combination of locking mechanisms. An extendable rail with a support brace provided at the rear end is connected to the body of the apparatus. Further, a back securement disposed at the bottom side of the body, wherein the back securement is connected to the left side module of the body using a first side securement and the right side module of the body using a second side securement. Furthermore, a key for locking the extendable rail in a plurality of configurations is provided. Herein, the key is inserted through one or more keyholes provided in the extendable rail and a socket provided at the rear end of the body.

7 Claims, 15 Drawing Sheets

(56) References Cited

U.S. PATENT DOCUMENTS

| | | | | |
|---|---|---|---|---|
| 2016/0265872 | A1 | 9/2016 | Tarazi | |
| 2018/0156568 | A1* | 6/2018 | Troy | F41C 23/14 |
| 2018/0224234 | A1* | 8/2018 | Macy | F41A 3/66 |

* cited by examiner

200

APPARATUS FOR IMPROVING THE PERFORMANCE OF FIREARMS

TECHNICAL FIELD

The present invention relates generally to gadgets that may act as stabilizing attachments for firearms. More particularly, the present invention is related to an add-on attachment for improving the stability and usability of firearms.

BACKGROUND

Firearms such as pistols and revolvers are widely used around the world for self-defense, hunting, sports, and related activities. These handguns generate a considerable amount of recoil when fired. Recoil (often called knockback, kickback, or simply kick) is the backward movement of a gun when it is discharged. In technical terms, the recoil momentum acquired by the gun exactly balances the forward momentum of the projectile and exhaust gases, according to Newton's third law, known as conservation of momentum. In hand-held small arms, the recoil momentum is transferred to the ground through the body of the shooter.

Muzzle rise (also known as muzzle climb) is one of the most common physical phenomena in all widely used firearms. Muzzle rise more specifically refers to the elevation of the muzzle of the firearm, caused by combined recoil from multiple shots being fired in quick succession. It has an adverse effect on the accuracy of automatic and rapid-fire semi-automatic firearms, causing a target to be overshot.

The primary reason for muzzle rise is that for nearly all guns, the bore axis (longitudinal centerline of the barrel) is slightly above the gun's center of mass, while the contact points between the shooter and the gun (e.g. grips and stock) are often all below the center of mass. When the gun is fired, the bullet motion and the escaping propellant gases exert a reactional recoil directly backward along the bore axis, while the countering forward push from the shooter's hands and body are well below it. This creates a rotational torque around the center of mass, which causes the gun to pitch upwards and the muzzle end to rise.

It reduces the accuracy of firing and makes it challenging to engage a target efficiently. Users will have to take aims repeatedly due to the movement caused by such forces and makes it difficult to engage a target for a subsequent round. Besides, untrained shooters and shooters under stressful circumstances may try to provide opposing force in anticipation of the recoil causing the muzzle to go off target. As the power of the cartridge increases, recoil forces and muzzle rise increase proportionally.

The absence of components such as a shoulder stock causes all the recoil forces to be transferred to the shooter's hand and wrist. Since the firearm's recoil forces release suddenly when the firearm is fired, it is difficult for the muscles in the hand, wrist, and forearm to provide the necessary counterforce to counter the recoil forces and maintain stability. Handguns also typically have very short barrels. Hence, a small movement such as a short flinch, shake, or unsteadiness by the shooter will translate into a wide margin of error with respect to the target.

Among other solutions, adding more ergonomic contact points serves as a very effective solution to overcome the abovementioned problem. Add-on apparatuses such as firearm braces have proved to be highly effective in minimizing the adverse effects caused by recoil.

US20160265872A1 discloses accessories attached to firearm magazine. In a first aspect, a mounting system to mount accessories to the magazine or magazine baseplate of a firearm is provided. In a more specific best mode, a handgun forearm brace and recoil suppression support, for example, for target shooting, training, and improved aim is discussed. The support structure is connected via a locking mechanism to the base of the handgun detachable magazine and extending rearward to a rear connector. The forearm brace is further configured to allow it to adjust and extend either above and over the forearm of the shooter or below the forearm of the shooter. This improved support connecting to the base of the magazine via a locking mechanism can be used as a universal support for all guns with a detachable magazine without requiring any alternations, modifications, or attachments to the gun itself.

U.S. Pat. No. 5,180,874A discloses a handgun assembly which includes a handgun with a barrel and a butt having a handgrip, and a novel handgun brace resting against but otherwise unconnected to the handgun. The brace is in the form of a unitary rod having an upraised front portion, an intermediate portion connected thereto and sloping downwardly and rearwardly therefrom, and a rear portion connected to the intermediate portion and extending downwardly and rearwardly therefrom. The front portion bears an upraised, preferably detachable fork that holds the gun barrel. The fork may be stepped to accommodate gun barrels of various diameters. The intermediate portion includes a palm rest and a gun butt holder. The palm rest and holder may be in the form of a single tube with an elongated recess into which the butt fits. There may be an elongated bottom slot in the tube up thru which a slideable stop pin fits to brace the back of the gun butt. The rear portion of the rod includes a forked arm or wrist grip, which may be releasably connected to a rear extension bearing a forked forearm- or upper arm-brace. The assembly is lightweight, compact and effective to steady a shooter's aim, principally for hunting purposes.

U.S. Pat. No. 7,437,847B1 discloses a pivotable shoulder stock for a handgun that allows the user to aim and fire a handgun around the corner of a building or other obstacle. The user can fire with relative accuracy from behind a building or other obstacle using a mirror attached to the shoulder stock. The mirror can be adjustably positioned for viewing to fire the handgun at about a ninety-degree (90°) angle in either a clockwise or counterclockwise direction. The mirror can be removed when firing the handgun in a linear direction similar to a rifle or for storage purposes. The pivotable shoulder stock is relatively simple to operate and can be quickly adjusted while under assault conditions.

U.S. Pat. No. 8,438,771B1 discloses a detachable pistol stock that includes a stock member having a butt, a comb disposed between a heel and a forearm recess, a pistol grip disposed proximal a fore-end, a forestock attached to a fore-end notch disposed underlying the pistol grip, wherein an extant pistol is releasably supportable within a receiving tray and compressibly engageable with a padded bracket disposed on the fore-end by a shooter's grip, whereby the detachable pistol stock is rapidly deployable and usable with an extent pistol, as desired, to increase accuracy in using said pistol.

The overwhelming number of patents filed in this area establishes the technical problem faced by handgun shooters as discussed in this section. The present disclosure provides a novel, simple, effective, and affordable solution to overcome the abovementioned drawbacks.

SUMMARY

In light of the disadvantages mentioned in the previous section, the following summary is provided to facilitate an understanding of some of the innovative features unique to the present invention and is not intended to be a full description. A full appreciation of the various aspects of the invention can be gained by taking the entire specification and drawings as a whole.

The present disclosure proposes a novel apparatus for improving the performance of firearms by proving better stability and ergonomics. It has been established that adding more ergonomic contact points serves as a very effective solution to overcome issues caused by recoil to an extent. Attachments such as firearm braces are highly effective in minimizing the adverse effects caused by recoil. Embodiments disclosed herein provide a firearm brace that acts as a stabilizing attachment for firearms. The apparatus disclosed herein may be easily attached and detached onto most of the handguns available in the market. The firearm brace disclosed herein improves the stability and usability of handguns. The apparatus disclosed herein may be attached to handguns by connecting them with the firearm's rails.

The apparatus may comprise a body having a left side module and a right side module secured together by a combination of locking mechanisms. An extendable rail with a support brace provided at the rear end may be connected to the body of the apparatus. Further, a back securement may be disposed at the bottom side of the body. The back securement may be connected to the left side module of the body using a first side securement and the right side module of the body using a second side securement. Furthermore, a key for locking the extendable rail in a plurality of configurations may be provided. Herein, the key may be inserted through one or more keyholes provided in the extendable rail and a socket provided at the rear end of the body.

This summary is provided merely for purposes of summarizing some example embodiments, to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following detailed description and figures.

The abovementioned embodiments and further variations of the proposed invention are discussed further in the detailed description.

Figure 1:
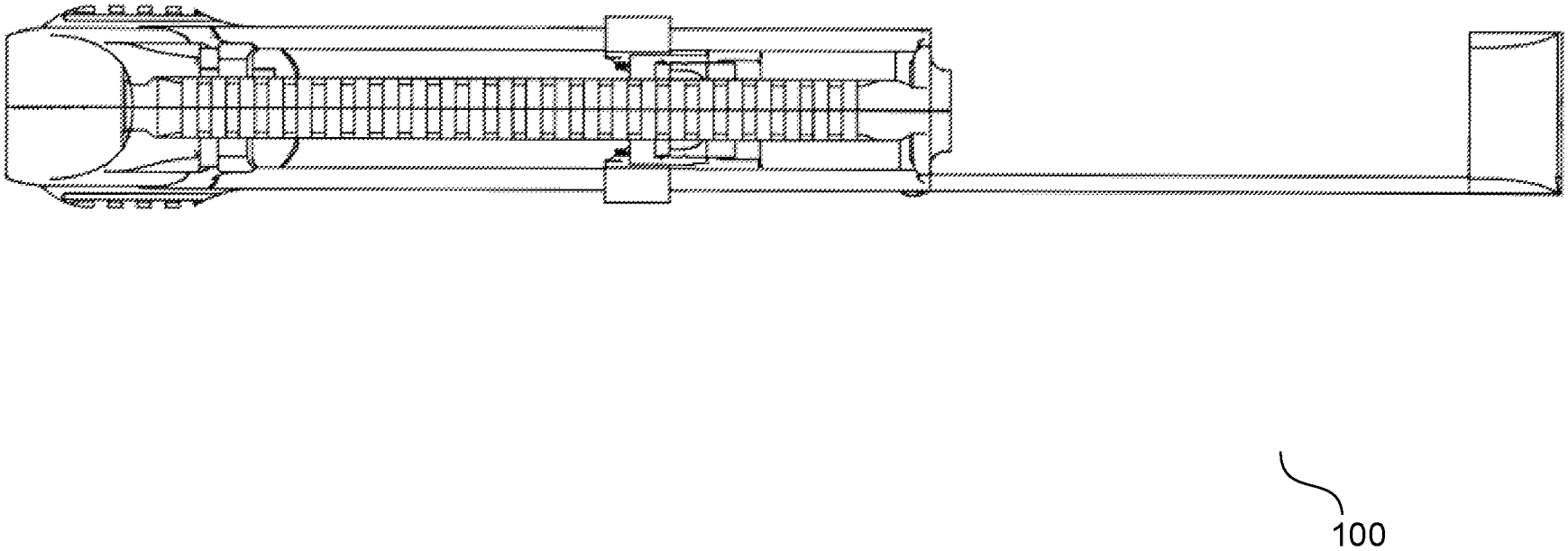
FIG. 1 is an exemplary illustration of the top view of the firearm brace according to the embodiments of the present disclosure.

The drawings described herein are for illustration purposes only and are not intended to limit the scope of the present subject matter in any way.

DETAILED DESCRIPTION

In the following description of the embodiments of the invention, reference is made to the accompanying drawings that form a part hereof, and in which are shown by way of illustration specific embodiments in which the invention may be practiced. These embodiments are described in sufficient detail to enable those skilled in the art to practice the invention, and it is to be understood that other embodiments maybe utilized and that changes may be made without departing from the scope of the present invention. The following detailed description is, therefore, not to be taken in a limited sense, and the scope of the present invention is defined only by the appended claims.

The specification may refer to "an", "one" or "some" embodiment(s) in several locations. This does not necessarily imply that each such reference is to the same embodiment (s), or that the feature only applies to a single embodiment. A single feature of different embodiments may also be combined to provide other embodiments.

As used herein, the singular forms "a", "an" and "the" are intended to include the plural forms as well, unless expressly stated otherwise. It will be further understood that the terms "includes", "comprises", "including" and/or "comprising" when used in this specification, specify the presence of stated features, integers, steps, operations, elements and/or components, but do not preclude the presence or addition of one or more other features integers, steps, operations, elements, components, and/or groups thereof. As used herein, the term "and/or" includes any and all combinations and arrangements of one or more of the associated listed items.

Unless otherwise defined, all terms (including technical and scientific terms) used herein have the same meaning as commonly understood by one of ordinary skill in the art to which this disclosure pertains. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Throughout this disclosure, the apparatus disclosed herein may be referred to as a "firearm brace", "firearm attachment", "pistol brace", "firearm adaptor", or "brace", interchangeably according to the context of the sentence. The terms used herein do not restrict the scope of the present disclosure.

The present disclosure proposes a novel solution for improving the performance of firearms. The apparatus disclosed herein is a firearm brace that may improve the overall efficiency of the firearm itself by improving its stability. The firearm brace disclosed herein may be a free-floating structure wherein the contact point that connects the pistol to the brace is at the rail under the barrel of the pistol. "Rail" herein refers to the entire family of firearm rails. Exemplary rails are Weaver rails and Picatinny rails, although other rails of various sizes and constructions known in the art or well within the grasp of the skilled artisan with routine design choices may be compatible with the disclosed apparatus as well.

Firearms such as pistols may be fastened onto the apparatus easily using standard commercially available fastening means such as Picatinny rails The Picatinny rail, or Pic rail for short, also known as a NHL-STD-1913 rail, is a military standard rail interface system that provides a mounting platform for firearm accessories. It was originally used for mounting scopes atop the receivers of larger caliber rifles. Once established, its use expanded to also attaching other accessories, such as iron sights, tactical lights, laser aiming modules, night vision devices, reflex sights, holographic sights, foregrips, bipods, slings and bayonets. Such interfaces are easily available in the market and are well known for their universal adaptability.

The rail consists of a strip undercut to form a "flattened T" with a hexagonal top cross-section, with cross slots interspersed with flats that allow accessories to be slid into place from the end of the rail and then locked in place. The Picatinny locking slot width is 0.206 in (5.23 mm). The spacing of slot centres is 0.394 in (10.01 mm) and the slot depth is 0.118 in (3.00 mm). Adding a Picatinny rail to the butt end of a revolver grip will allow for the attachment of all standard accessories. If the rail was oriented laterally with an appropriate locking means, it would give a stronger and more ergonomic connection means specifically for the purpose of attaching accessories such as cheek welds, forearm braces, monopods, and bipods to the firearm. The apparatus disclosed herein may be used along with pistols of various configurations and sizes by fastening it to the apparatus using standard Picatinny rails by means of fastening mechanisms such as Allen bolts. The apparatus may be adapted to work with other commercially available fastening means as understood by a person skilled in the art.

Embodiments disclosed herein provide a firearm brace that acts as a stabilizing attachment for firearms such as pistols, handguns, and the like. The apparatus disclosed herein may be easily attached and detached onto most of the handguns available in the market via standard connecting means as discussed above. The apparatus may primarily comprise a body that may be cylindrically shaped with a plurality of openings and modifications of different shapes and sizes along its surface strategically placed for performing various functions. The body may be divided into two sections the first being a left side module and the second being a right side module. The left side and the right side modules may be secured together by a combination of locking mechanisms. The locking mechanisms may include a plurality of strategically placed fasteners, sliders, or other locking mechanisms provided on the left and right side modules of the body. The body may act as the housing for various other components of the apparatus.

An extendable rail that extends outwards the body of the apparatus horizontally to the rear side may be provided. The rail may slide through an extended slit provided on any one side of the body of the apparatus. The length of the apparatus increases with the extension of the rail and decreases with the retraction of the rail. The rail may be pulled out from the rear end of the body and vice versa. The rear end of this rail may be fixed with a support brace 1208. The support brace 1208 may act as cheek weld or arm support while using the firearm. Locking mechanisms may be provided to use the extendable rail at various configurations (lengths).

Before moving to the succeeding sections of this disclosure that describes the working of the apparatus in detail, it is pertinent to refer to various reference numbers provided in the drawings.

Figure 2:
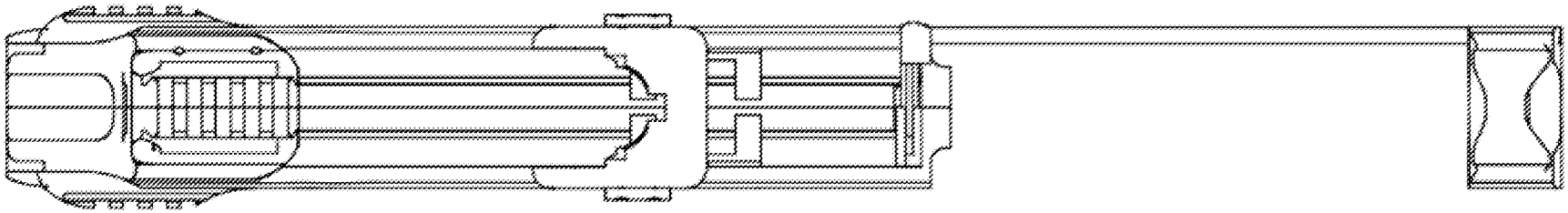
FIG. 2 is an exemplary illustration of the bottom view of the firearm brace according to the embodiments of the present disclosure.
Figure 3:
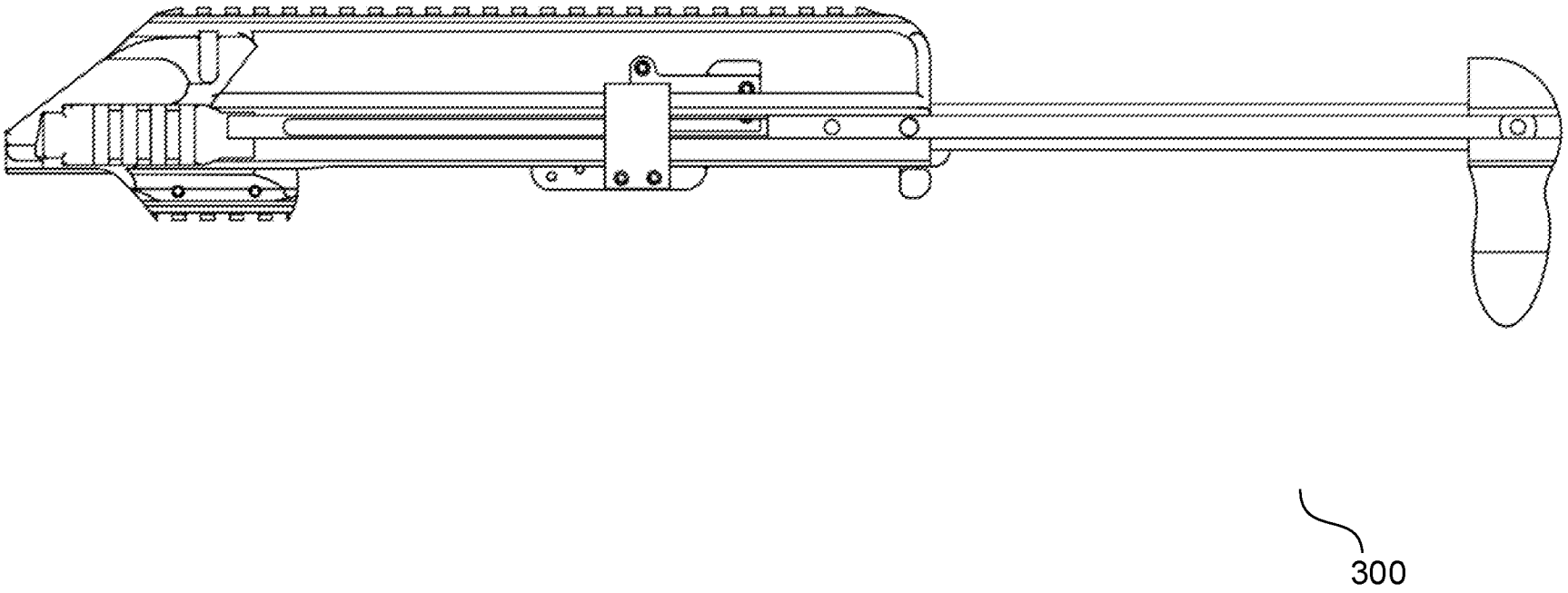
FIG. 3 is an exemplary illustration of the right side view of the firearm brace according to the embodiments of the present disclosure.
Figure 4:
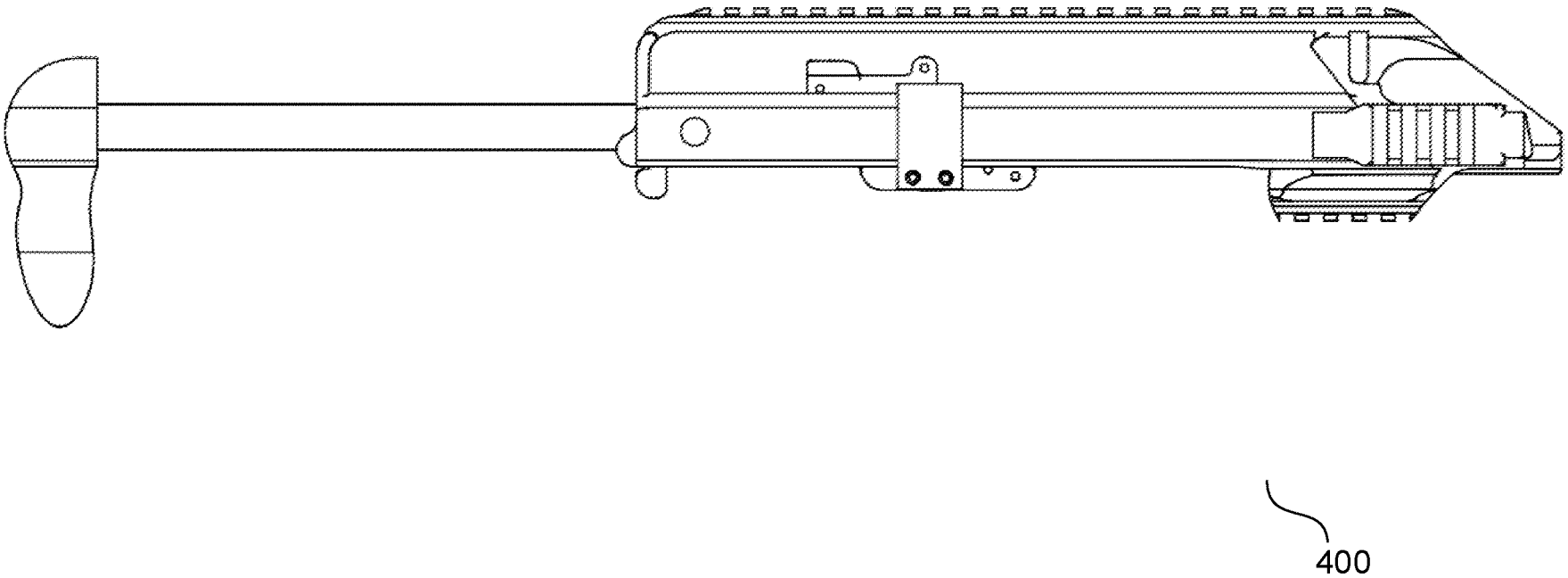
FIG. 4 is an exemplary illustration of the left side view of the firearm brace according to the embodiments of the present disclosure.

FIG. 1 is an exemplary illustration of the top view 100 of the firearm brace while FIG. 2 is an exemplary illustration of the bottom view 200 of the firearm brace according to the embodiments of the present disclosure. FIG. 3 is an exemplary illustration of the right side view 300 and FIG. 4 is an exemplary illustration of the left side view 400 of the firearm brace according to the embodiments of the present disclosure.

Figure 5:
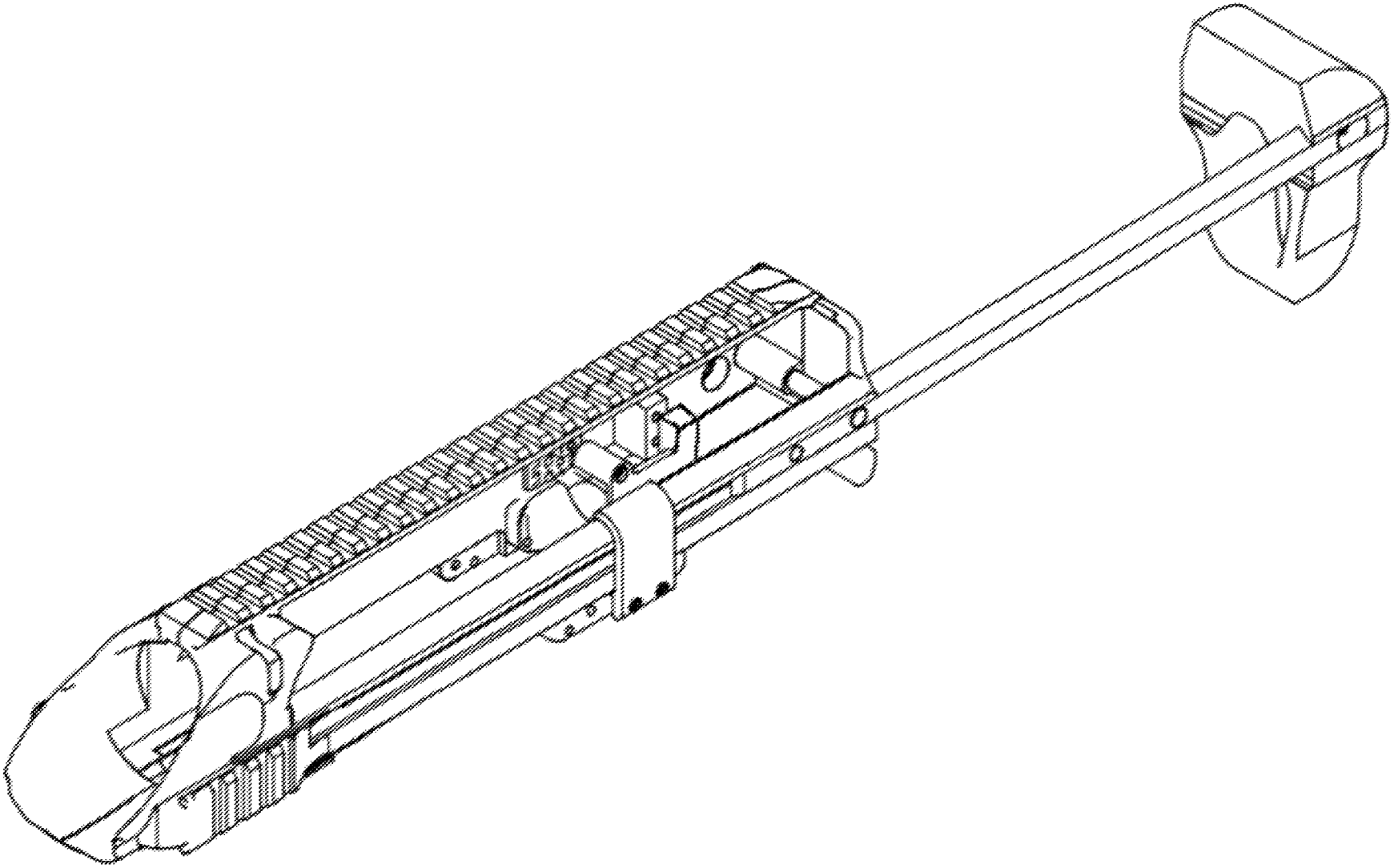
FIGS. 5-6 are exemplary top perspective views of the firearm brace with the extendable rail in an extended configuration according to the embodiments of the present disclosure.
Figure 6:
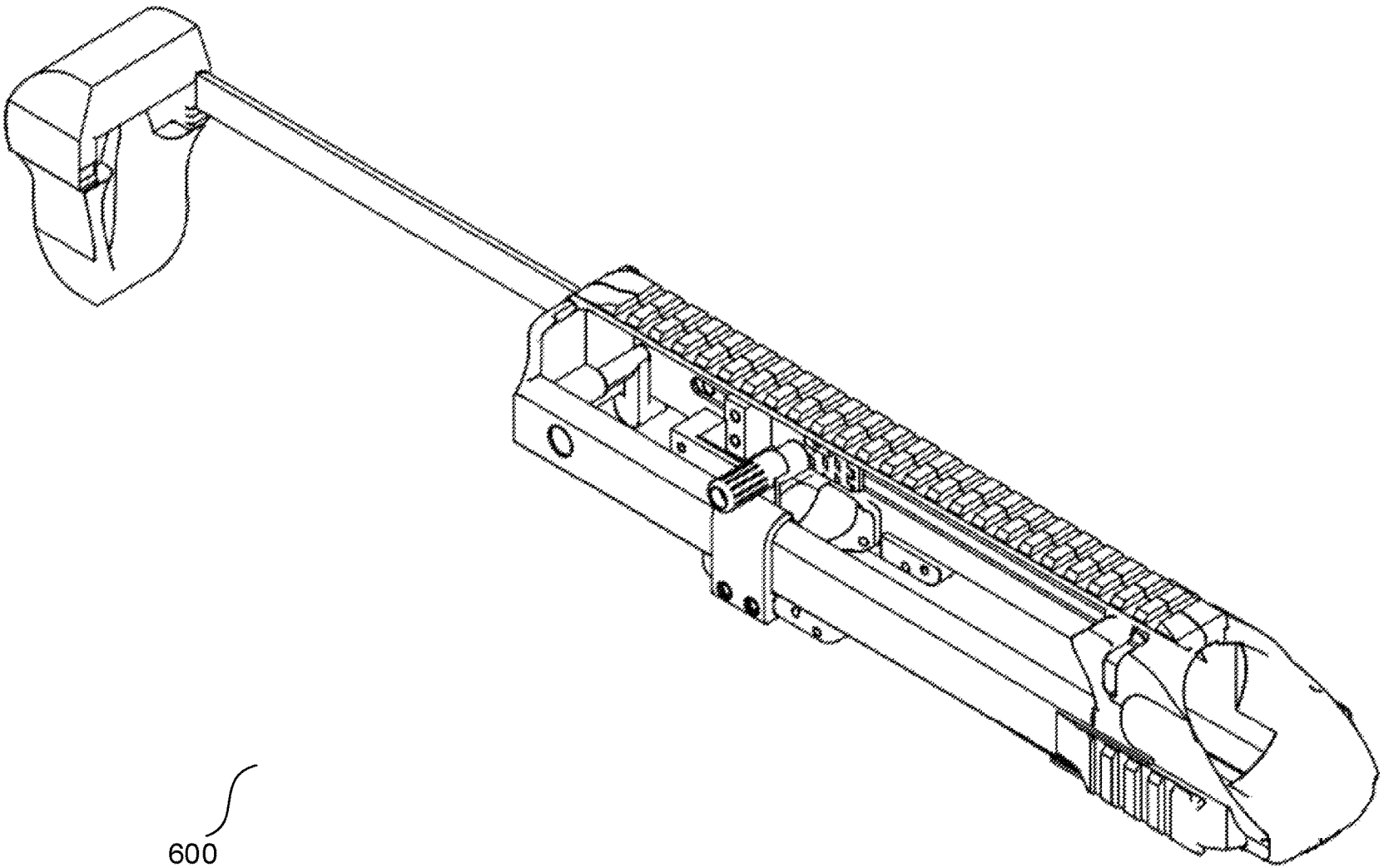

FIG. 5 is an exemplary top, left perspective view 500 and FIG. 6 is an exemplary top, right perspective view 600 of the firearm brace with the extendable rail in an extended configuration according to the embodiments of the present disclosure.

Figure 7:
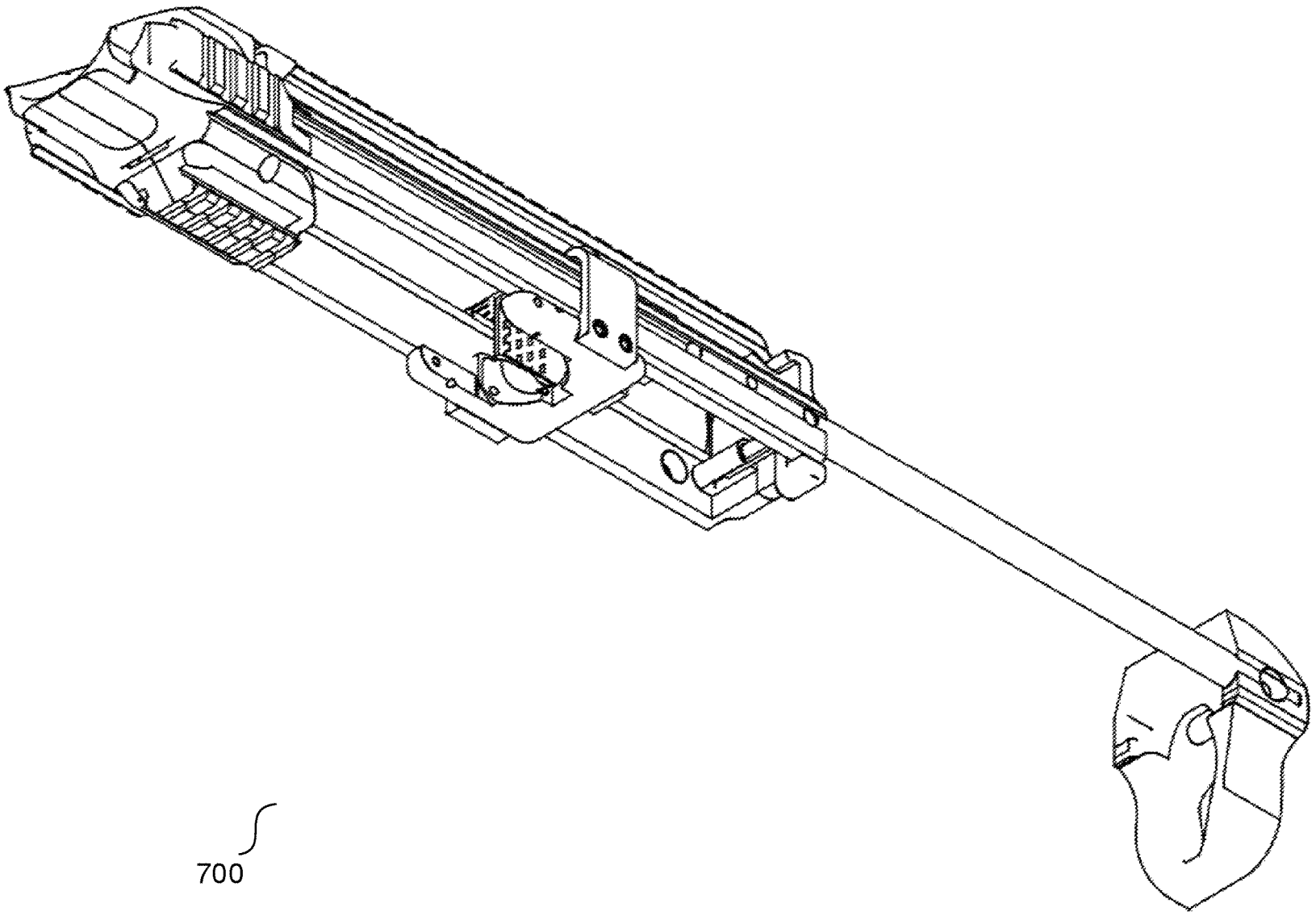
FIGS. 7-8 are exemplary bottom perspective views of the firearm brace with the extendable rail in an extended configuration according to the embodiments of the present disclosure.
Figure 8:
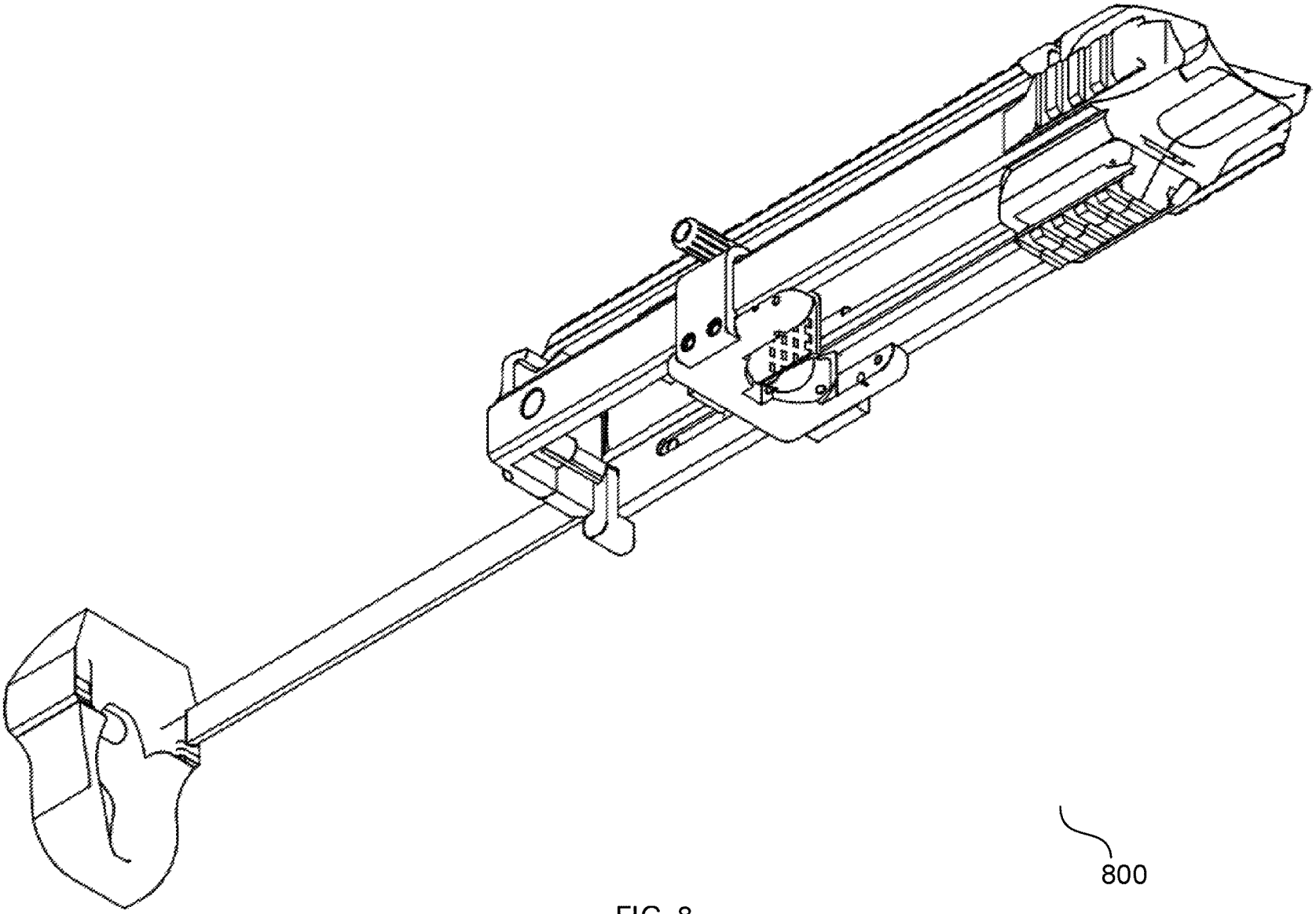

FIG. 7 is an exemplary bottom, left perspective view 700 and FIG. 8 is an exemplary bottom, right perspective view 800 of the firearm brace with the extendable rail in an extended configuration according to the embodiments of the present disclosure.

Figure 9:
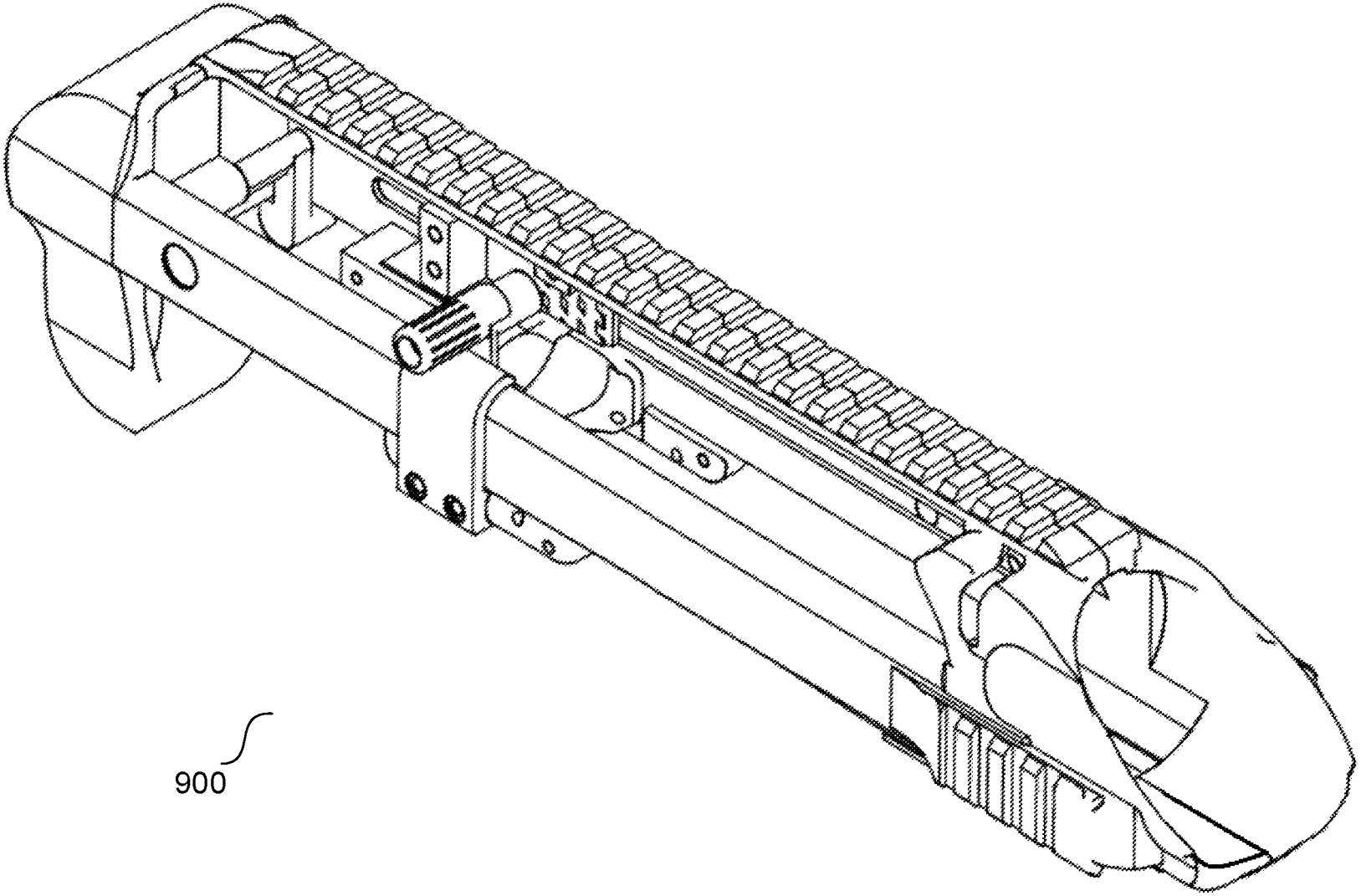
FIG. 9 is an exemplary top perspective view of the firearm brace with the extendable rail in a retracted configuration according to the embodiments of the present disclosure.
Figure 10:
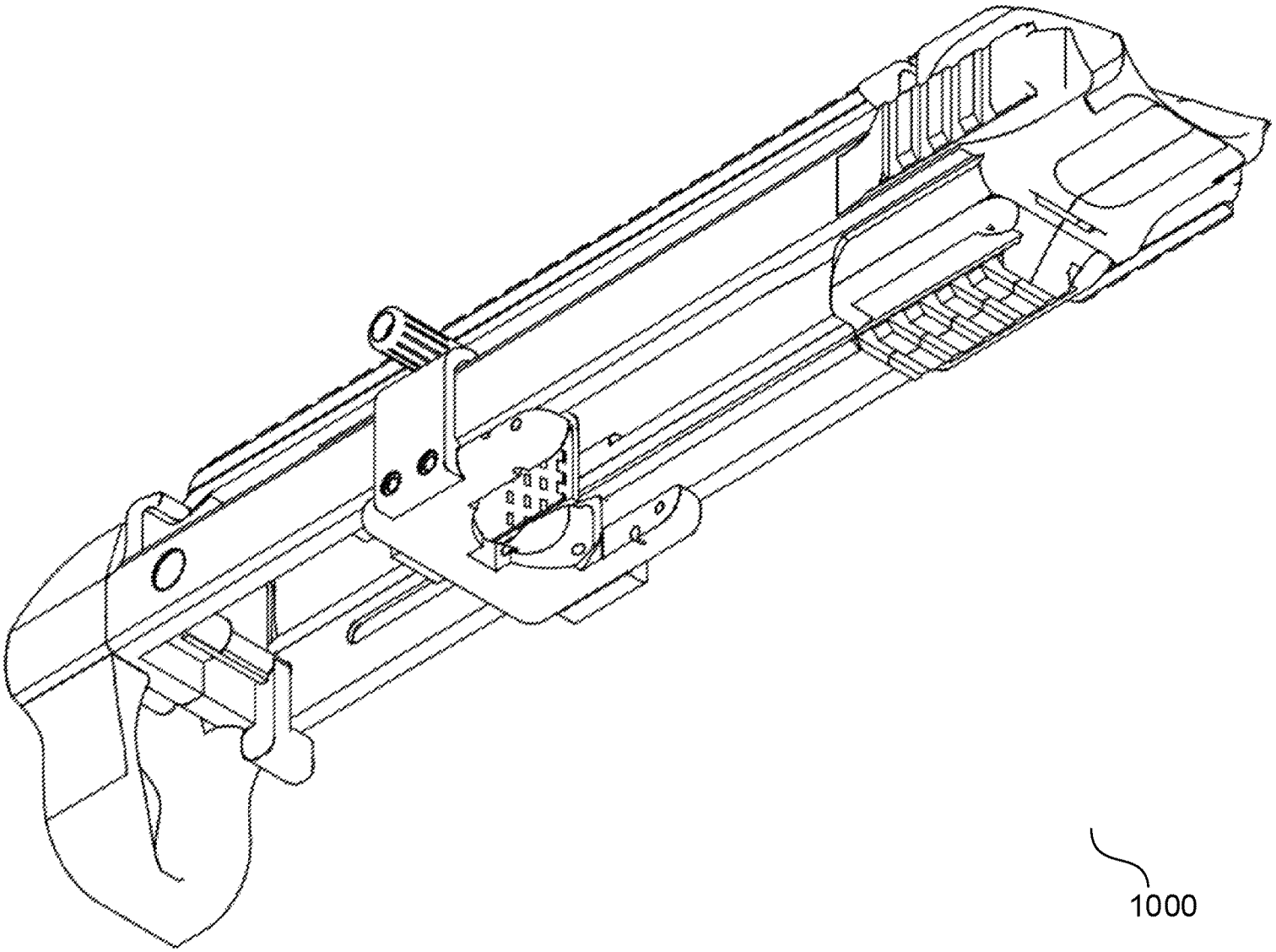
FIGS. 10-11 are exemplary bottom perspective views of the firearm brace with the extendable rail in a retracted configuration according to the embodiments of the present disclosure.
Figure 11:
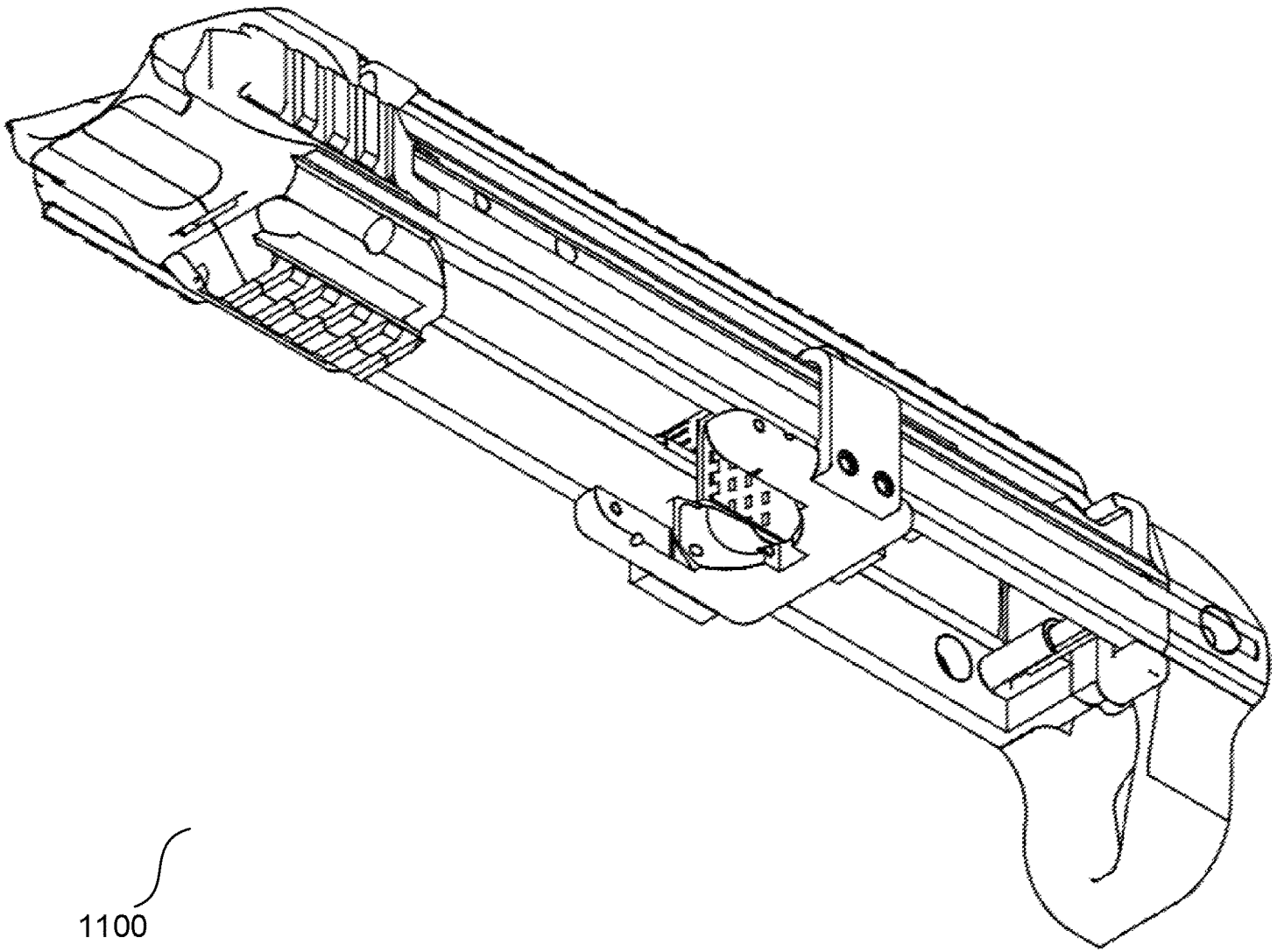

FIG. 9 is an exemplary top right perspective view 900, FIG. 10 is a bottom right perspective view 1000, and FIG. 11 is a bottom left perspective view 1100 of the firearm brace with the extendable rail in a retracted configuration according to the embodiments of the present disclosure.

Figure 12:
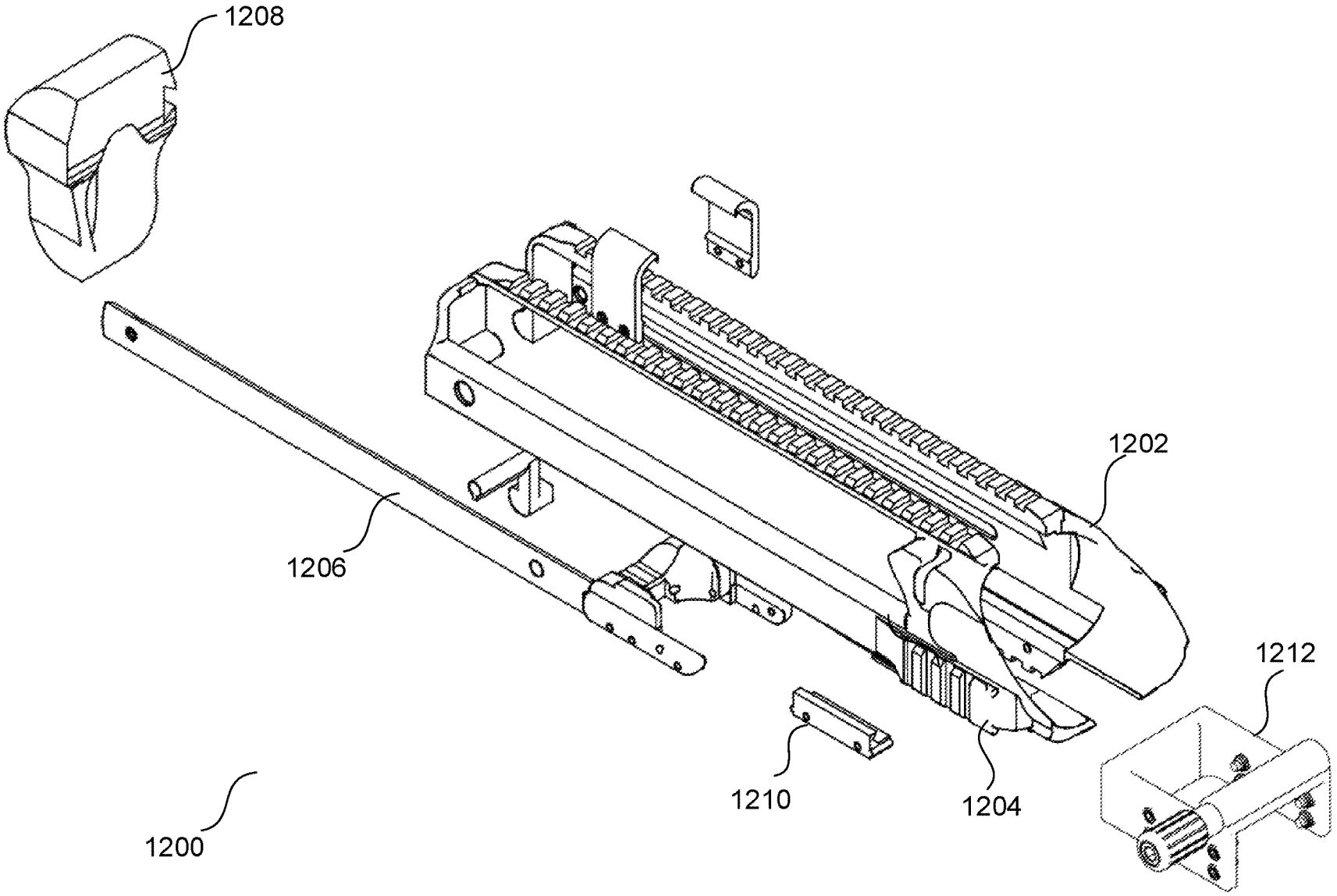
FIGS. 12-13 are exemplary explosive views of the firearm brace according to the embodiments of the present disclosure.
Figure 13:
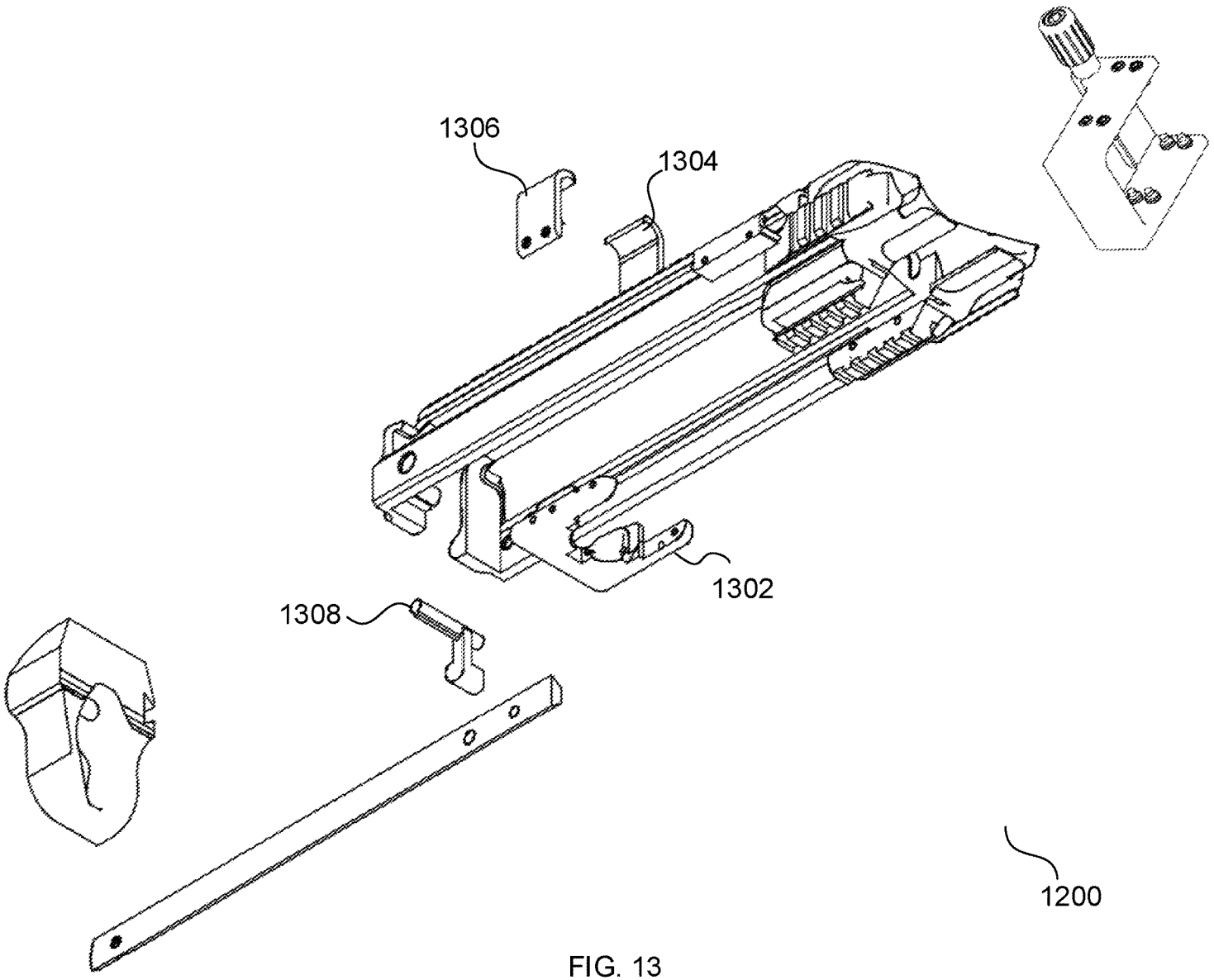

FIGS. 12 and 13 are exemplary explosive views 1200 and 1300 of the firearm brace according to the embodiments of the present disclosure. Various components of the apparatus will be referenced using explosive views provided in FIGS. 12 and 13 as they depict almost all components of the apparatus comprehensively. In FIG. 12, the body of the apparatus is shown as two modules, the left side module 1202 and the right side module 1204. The extendable rail 1206 may be connected to the left or right side module 1204 depending upon the requirement of the user (changes may be made for left and right handed users). The support brace 1208 may be connected to the rear end of the extendable rail 1206 as illustrated clearly in the preceding figures. A pic lock 1210 may be used as one of the locking mechanisms for securely connecting the left and right side modules of the apparatus's body. The apparatus may further be provided with a charging system 1212.

In FIG. 13, the bottom side of the apparatus may be clearly seen. The back securement 1302 may be provided between the left side module 1202 and the right side module 1204. The back securement 1302 may be connected to the left side module 1202 using a first side securement 1304 and to the right side module 1204 using a second side securement 1306. A key 1308 may be used to lock the extendable rail 1206 to the body of the apparatus.

Figure 14A:
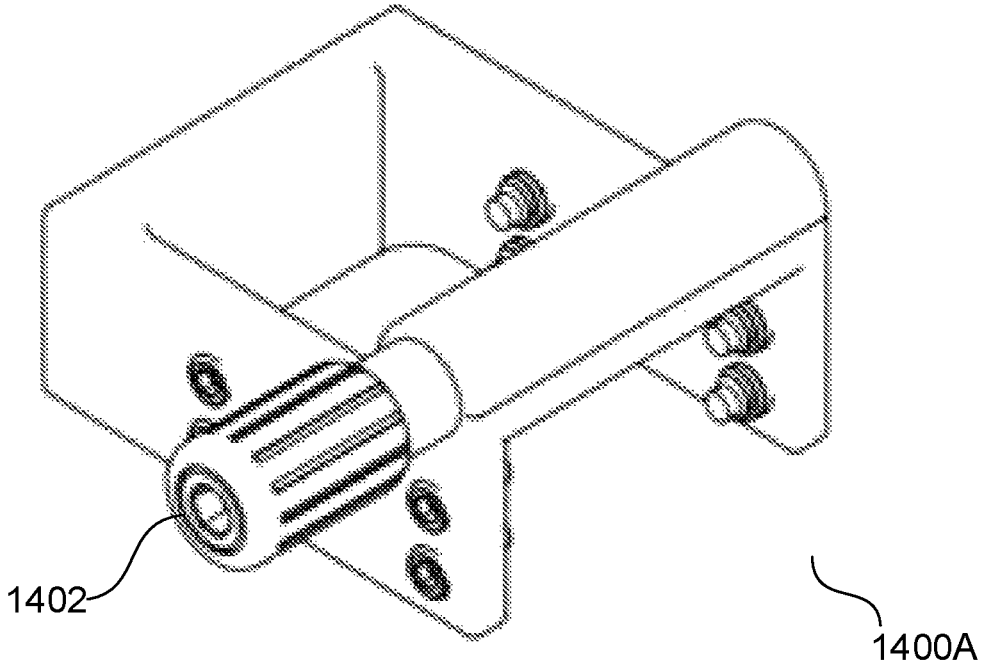
FIGS. 14A and 14B are top perspective views of the charging system used with the firearm brace according to the embodiment of the present disclosure.
Figure 14B:
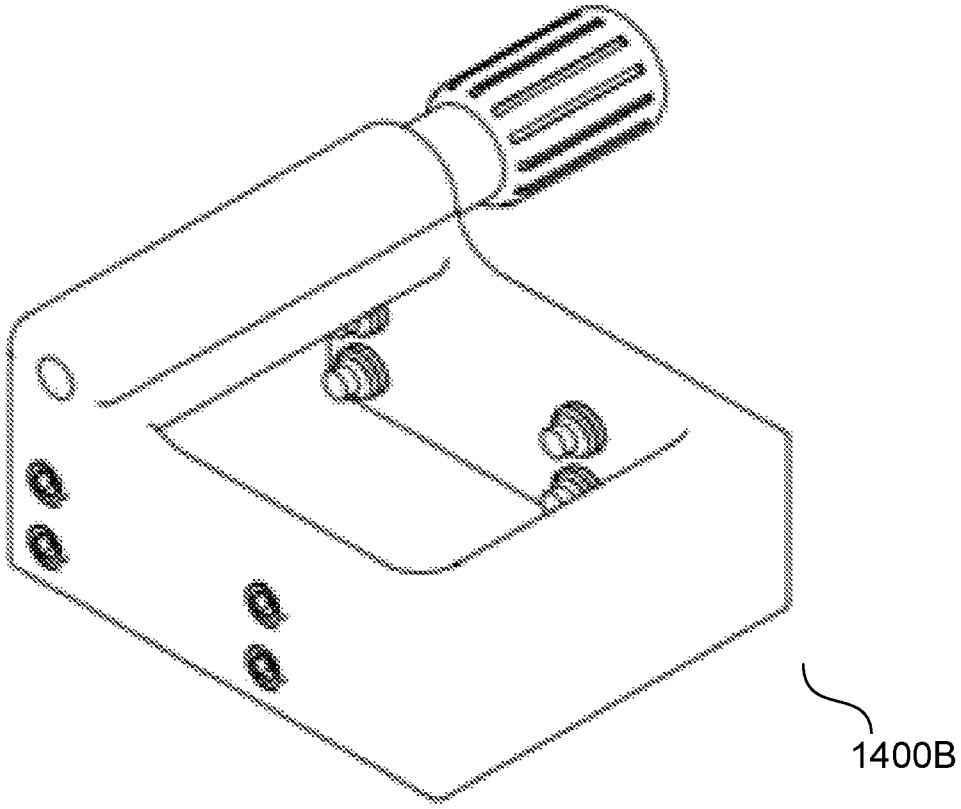
Figure 15A:
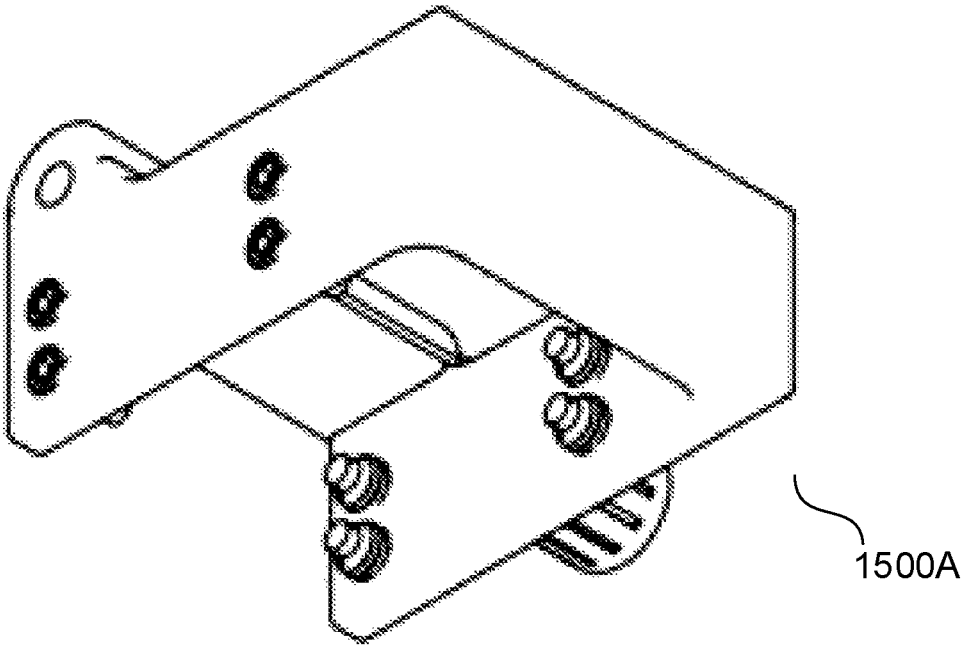
FIGS. 15A and 15B are bottom perspective views of the charging system used with the firearm brace according to the embodiment of the present disclosure.
Figure 15B:
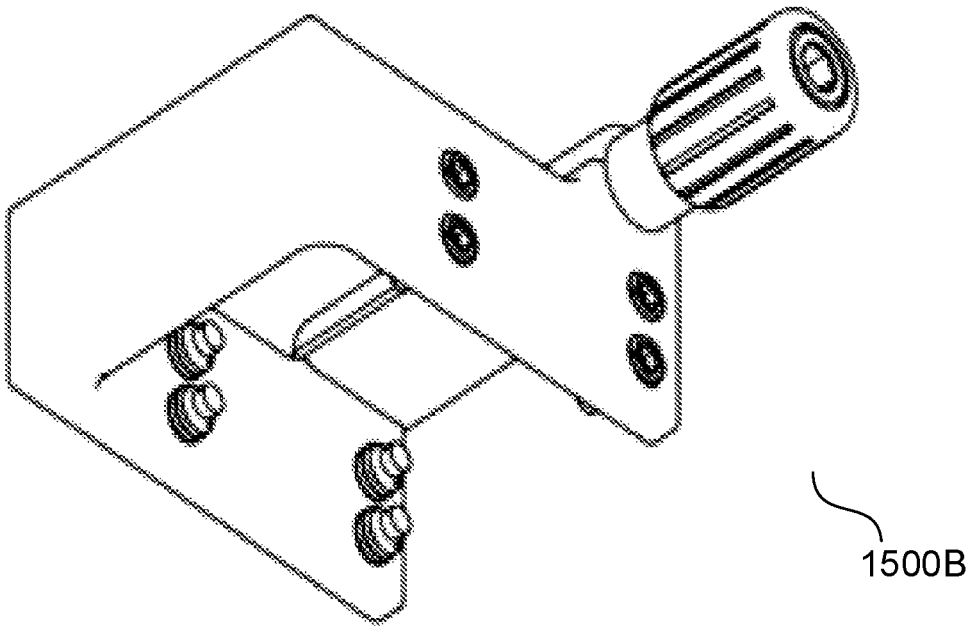

FIGS. 14A and 14B are top perspective views 1400A and 1400B of the charging system 1212 used with the firearm brace according to the embodiment of the present disclosure. The charging system 1212 may further have a charging handle 1402. FIGS. 15A and 15B are bottom perspective views 1500A and 1500B of the charging system used with the firearm brace according to the embodiment of the present disclosure.

The key 1308 may be used for locking the extendable rail in a plurality of configurations. The key 1308 may be inserted through one or more keyholes provided in the extendable rail 1206 and a socket provided at the rear end of the body. The key 1308 may pass through the extendable rail 1206 as well as the socket provided in the body of the apparatus. The key 1308 may lock the extendable rail 1206 at a fixed length. Depending upon the number of keyholes provided in the extendable rail 1206 its configuration (length) may be modified. During operation, a user may extend the rail and insert the key 1308 through the keyhole and into the socket to fix the length/configuration of the apparatus.

The front side of the body of the apparatus may further be provided with a blast shield. The body of the apparatus may be fastened to Picatinny rails of the firearm using a plurality of fastening mechanisms as understood by a person skilled in the art. In one example, Allen bolts may be used for fastening the firearm to the apparatus.

In one example, the firearm brace disclosed herein may be connected to the firearm by attaching it to a forward bottom Picatinny rail under the barrel of the pistol. The connection may be completed using a set of screws or related fastening means. The firearm brace may be a free-floating structure wherein the lone contact point maybe around the Picatinny rail near the front side of the pistol. This design may increase the stability of the pistol and counters recoil effectively.

While the front portion of the firearm may be connected to the front portion of the body of the apparatus using abovementioned technique, the rear portion of the firearm may securely grip onto the back securement 1302. The apparatus may further be used along with a novel charging system 1212 that includes the charging handle 1402. Upon installation to the apparatus disclosed herein, the charging handle 1402 may extend outwards from the body of the apparatus. The body of the apparatus may have cutout portions through which the charging handle may move freely during operation. The charging handle may be universal and adaptable and may work with a wide variety of firearms as understood by a person skilled in the art.

The left side module 1202 and the right side module 1204 of the body of the apparatus may be securely connected using one or more locking mechanisms. The combination of locking mechanisms used herein may include pic locks, male dove tail connecting mechanisms, female dove tail connecting mechanisms, and the like. Furthermore, the back securement 1302, the first side securement 1304, and the second side securement 1306 of the apparatus may be fastened to the body of the apparatus using a set of screws. Allen bolts or any other related screws or fastening mechanisms may be used for this purpose.

The top side of the apparatus may comprise rails as described in the figures. Attachments such as red dot sights may be easily connected to the top rail of the apparatus. In one example, a red dot sight may be fixed onto the top rail of the apparatus. Herein, red dot sight is a common classification for a type of non-magnifying reflector (or reflex) sight for firearms, and other devices that require aiming, that gives the user an Aimpoint in the form of an illuminated red dot. They are considered to be fast-acquisition and easy-to-use gun sights for target shooting, hunting, and in police and military applications. The connectors provided on the top side of the pistol brace allows attaching most of the commercially available standard red dot sights. The rear end support of the brace may be rested preferably near the shooter's cheek area or any other part of the user's body as understood by a person skilled in the art while firing shots using the firearms. The support brace 1208 may act as cheek weld or arm support while using the firearm. Users may adapt to different methods and techniques for positioning the rear end support according to their shooting style. The support brace 1208 may be rested at various contact points of the shooters body as understood by a person skilled in the art. Essentially, the brace reduces effects caused by recoil and helps the shooter stabilize their shot placement and assists the shooter in achieving more consistent short or medium range shots. The firearm brace disclosed herein improves the stability and usability of handguns.

The telescopic structure of the apparatus allows users to easily change the length of the brace as per their requirements. In one example, the extending rail of the apparatus may be configured with a spring-based functionality as well. Herein, the rail may be kept under a tension provided by a compression spring. Buttons/triggers may be used to push the rail outwards to instantly increase the length of the brace as and when required by the user. In another example, the brace may be provided with magazine holders at the bottom side of the apparatus for carrying backup magazines. The rails provided on the top side of the apparatus further increases the scope and adaptability of the brace. Most plug and play additions that are compatible with rail-type connectors may be easily attached/detached to the apparatus easily as understood by a person skilled in the art.

In addition to the abovementioned examples, the apparatus may further be provided with a holster for easy transportation and secure storage. The holsters may further be provided with clips that may be used to clip the holster onto objects such as bags and carry cases. In one example, a backpack plate with a plurality of threaded holes may be provided. With this arrangement, users may be able to screw the holster onto the backpack plate at desired heights thereby making it easy to carry and adaptable as per the user's comfort.

The body and different supporting components of the apparatus may be manufactured using materials generally used in manufacture of firearm supports as understood by a person skilled in the art. In one example, the body may be manufactured using polymers of different grades and/or Nylon (such as PA66GF33 Nylon) along with other components. In one example, the brace attached to the extended rail may be manufactured using rubber-based materials such as sanoprene rubber or soft plastics. The charging handle 1402 may be manufactured using cast aluminum or other related metals as understood by a person skilled in the art. The extendable rail 1206 may be manufactured using metals or alloys. In one example, alloys of aluminum can be used for manufacturing this piece.

It may be noted that the above-described examples of the present solution are for the purpose of illustration only. Although the solution has been described in conjunction with a specific embodiment thereof, numerous modifications may be possible without materially departing from the teachings and advantages of the subject matter described herein. Other substitutions, modifications, and changes may be made without departing from the spirit of the present solution. All the features disclosed in this specification (including any accompanying claims, abstract, and drawings), and all of the steps of any method or process so disclosed, may be combined in any combination, except combinations where at least some of such features or steps are mutually exclusive.

The terms "include," "have," and variations thereof, as used herein, have the same meaning as the term "comprise" or an appropriate variation thereof. Furthermore, the term "based on", as used herein, means "based at least in part on." Thus, a feature that is described as based on some stimulus can be based on the stimulus or a combination of stimuli including the stimulus.

The present description has been shown and described with reference to the foregoing examples. It is understood, however, that other forms, details, and examples can be made without departing from the spirit and scope of the present subject matter that is defined in the following claims.

What is claimed is:

1. An apparatus for stabilizing firearms comprising, a body comprising a left side module and a right side module secured together by a combination of locking mechanisms;

an extendable rail having one or more keyholes connected to the left side module or the right side module of the body;

a support brace connected to the rear end of the extendable rail;

a back securement for the firearm disposed at the bottom side of the body, wherein the back securement is connected to the left side module of the body using a first side securement and the right side module of the body using a second side securement, wherein the back securement, the first side securement, and the second side securement are fastened to the body of the apparatus using a set of screws; and a key for locking the extendable rail in a plurality of configurations wherein the key is inserted through one of the one or more keyholes provided in the extendable rail and a socket provided at the rear end of the body.

2. The apparatus of claim 1, wherein a blast shield is provided at the front end of the body.

3. The apparatus of claim 1, wherein the body of the apparatus is fastened to picatinny rails of the firearm using Allen bolts.

4. The apparatus of claim 3, wherein the rear side of the firearm is securely gripped to the back securement.

5. The apparatus of claim 1, further comprising a charging system including a charging handle wherein the charging handle extends outwards from the body of the apparatus.

6. The apparatus of claim 5, wherein the charging handle freely moves along an opening provided in the body of the apparatus.

7. The apparatus of claim 1, wherein the combination of locking mechanisms securing the right side module and the left side of module of the body consists pic locks, male dove tail connecting mechanisms, and female dove tail connecting mechanisms.

* * * * *